US005817382A

United States Patent [19]

Cheng

[11] Patent Number: 5,817,382

[45] Date of Patent: Oct. 6, 1998

[54] METHOD AND APPARATUS FOR MANUFACTURING SHEETS FOR WRAPPING PRODUCTS, SUCH AS FLOWERS AND THE LIKE

[75] Inventor: Sheng Chi Cheng, Kaohsiung, Taiwan

[73] Assignee: Jei Lee Corporation, Taiwan

[21] Appl. No.: 603,685

[22] Filed: Feb. 20, 1996

Related U.S. Application Data

[63] Continuation of Ser. No. 218,600, Mar. 25, 1994, abandoned.

[30] Foreign Application Priority Data

Mar. 17, 1994 [NL] Netherlands ..... 9400424

[51] Int. Cl.[6] ..... B65D 65/14

[52] U.S. Cl. ..... 428/40.1; 47/72; 229/87.01; 428/194; 428/200; 428/202; 428/343; 428/906

[58] Field of Search ..... 428/40.1, 194, 428/200, 202, 343, 906; 229/87.01; 47/72

[56] References Cited

U.S. PATENT DOCUMENTS

| | | | |
|---|---|---|---|
| H377 | 12/1987 | Greig | 428/41.8 |
| 3,032,181 | 5/1962 | Hutter | 428/40.1 |
| 3,616,750 | 11/1971 | Gottscho et al. | 101/157 |
| 3,752,304 | 8/1973 | Alef | 428/194 |
| 3,788,876 | 1/1974 | Baker | 428/200 |
| 4,351,238 | 9/1982 | Harpold | 101/128.4 |
| 4,420,520 | 12/1983 | Jones | 428/40 |
| 4,460,634 | 7/1984 | Hasegawa | 428/42.1 |
| 4,842,919 | 6/1989 | David | 428/40 |
| 5,009,944 | 4/1991 | Maruyama | 428/40 |
| 5,557,844 | 9/1996 | Bhatt | 29/852 |

FOREIGN PATENT DOCUMENTS

| | | |
|---|---|---|
| 450046 | 1/1972 | Australia . |
| 2016799 | 2/1971 | Germany . |
| 1150154 | 4/1969 | United Kingdom . |
| 9003311 | 4/1990 | WIPO . |
| 9114621 | 10/1991 | WIPO . |

OTHER PUBLICATIONS

** European Search Report.

*Primary Examiner*—Nasser Ahmad
*Attorney, Agent, or Firm*—Michaelson & Wallace; Peter L. Michaelson; Michael P. Straub

[57] ABSTRACT

The invention relates to a method of manufacturing film sheets provided with adhesive means, to be used for wrapping products, such as, for instance, flowers and plants, wherein a band of film is provided with a series of imprints in an adhesive material, which imprints form the adhesive means, whereafter the film band is cut into film sheets to be used separately. The invention moreover relates to an apparatus for the manufacture of film sheets provided with adhesive means, to be used for wrapping products, such as, for instance, flowers and plants.

6 Claims, 4 Drawing Sheets

METHOD AND APPARATUS FOR MANUFACTURING SHEETS FOR WRAPPING PRODUCTS, SUCH AS FLOWERS AND THE LIKE

This application is a file wrapper continuation of now abandoned U.S. patent application Ser. No. 08/218,600 which was filed on Mar. 25, 1994 and entitled "A method and apparatus for manufacturing sheets for wrapping products, such as flowers and the like".

FIELD OF THE INVENTION

The invention relates to a method of manufacturing film sheets provided with adhesive means, to be used for wrapping products, such as, for instance, flowers and plants. The invention further relates to an apparatus for manufacturing film sheets provided with adhesive means, to be used for wrapping products, such as, for instance, flowers and plants, to film sheets, to be used for wrapping products, such as, for instance, flowers and plants, to a stack of such film sheets and to a rolled-up film band, suitable for use in the manufacture of such film sheets.

BACKGROUND OF THE INVENTION

For wrapping flowers and the like, film sheets are used wherein the flowers can be wrapped. It is known to provide such film sheets with an adhesive edge along a longitudinal edge extending transversely to the direction of wrapping and whereby the relevant longitudinal edge of the film sheet, after being wrapped round the flowers, can be adhered to another part of the film sheet. An advantage hereof is that it requires no further operations for closing the wrapping, such as the winding thereof with a string or an elastic band.

Conventionally, the film sheets are manufactured from a roll of film material which is cut into sheets having the desired shape. Prior to being used for wrapping the flowers, these sheets are provided with the desired adhesive edge by moving the sheet under a device suitable therefor, while a straight adhesive applicator can be moved against the sheet. This method has a a drawback that for use, the sheets are stacked loosely on top of each other, so that the manufacture, storage, transport and use of the sheets are inconvenient because the loose stack does not retain its shape. Moreover, each time when a bunch of flowers is to be wrapped, a sheet should be moved under the applicator and the applicator should be operated. This is time-consuming and susceptible to trouble. There is a chance that the film sheet is provided with an adhesive edge in an irregular manner, if at all, so that the wrapping will be inferior.

It is also known to manufacture such film sheets by cutting a sheet from a roll of film band each time before the wrapping of a bunch of flowers and to simultaneously provide it, in the above-described manner, with the adhesive edge. It is true that this avoids the drawback of having to use sheets that are loosely stacked on top of each other, but it involves the drawback of the user having to cut off a sheet from the roll each time and, subsequently, providing the adhesive imprint, which is labor-intensive and time-consuming and may for instance lead to the provision of an inferior adhesive edge. Moreover, in the two above-described methods, a film sheet may become creased before being provided with an adhesive edge, yielding a poor adhesion of the film sheet and an unpleasant appearance of the wrapped products.

SUMMARY OF THE INVENTION

The object of the invention is to provide a method of the type described in the preamble, wherein the drawbacks of the known methods are avoided, while the advantages are maintained. To this end, the method according to the invention is characterized in that a band of film is provided with a series of imprints in an adhesive material, which imprints form the adhesive means, whereafter the film band is cut into film sheets to be used separately.

This method has as an important advantage that the film sheets are not loosely manufactured and stacked, and the manufacture, transport, storage and use of the film sheets are simplified. Moreover, the film sheets, after the cutting thereof, are ready for use, allowing the flowers to be wrapped more quickly and simply and, moreover, precluding the chance of forgetting the provision of an adhesive strip or the careless provision thereof. Moreover, all sheets have identical shapes, dimensions and imprints, providing the products with a particularly pleasant appearance when wrapped.

In the method according to the invention, the film sheets, after they have been cut, are preferably stacked on top of each other in such a manner that the adhesive imprints are arranged substantially directly above each other and each film sheet comprises at least one of these adhesive imprints whereby the film sheets are connected to each other. As a result, a pack of film sheets that is easy to handle is formed. The fact that before cutting the film sheets, the film bands are provided, through imprinting, with the adhesive means, ensures that each film sheet is provided, in a regular manner, with an adhesive imprint, whereby each film sheet in the stack is fixedly connected to at least a superjacent or subjacent film sheet. In fact, the imprint can have any desired shape.

In a preferred embodiment of the method according to the invention, a release agent is provided on the film, in particular on at least a part of the side of the film band remote from the adhesive imprints, in such a manner that, as the stack is being formed, the release agent is included between each adhesive imprint and the adjacent film sheet. This release agent has the advantage that it reduces the adhesion of the imprint in the stack and hence the mutual adhesion between the film sheets in the stack. When the film sheets are used for wrapping products, the release agent does not influence the adhesion between the adhesive imprint and the film sheet, because this involves the imprint being pressed directly against the film material, without the interposition of the release agent.

In a further elaboration of the method according to the invention, each adhesive imprint is provided in the form of at least two strips that include an angle, a stack of film sheets having the desired shape being cut from the stack of film sheets. Preferably, the stack of film sheets is cut or blanked in such a manner that a strip of adhesive material is located in the vicinity of at least two longitudinal edges of each film sheet. With this method, film sheets can be formed having a shape other than rectangular, for instance a shape which is more in keeping with the shape of a bunch of flowers or pot plant to be wrapped. The presence of two adhesive strips including an angle, each extending along a longitudinal edge of the cut film sheet, results in the film sheets in the stack being interconnected along at least two edges. Consequently, in a simple manner, a firm, substantially block-shaped stack of film sheets is obtained that is easy to handle.

It is preferred that each adhesive imprint is provided on the film band in the form of a large number of surfaces and an interspace kept free from adhesive is included between each pair of adjacent surfaces. The surfaces and interspaces are small relative to the film sheet. This creates a connection between film sheets in the stack sufficiently strong to form a firm, convenient stack, while the film sheets can still be separated from each other without much difficulty.

In a preferred embodiment of the method according to the invention, each imprint is provided by means of a rotary printing process and is subsequently dried, after which the film band, at the printed side thereof, is covered by a layer of film-like material, such as paper, after which the printed film band together with the covering layer is rolled up for transport or storage, a thus formed roll of printed film is unrolled prior to the cutting operation while the covering layer is removed and the film band is supplied to a device for cutting the sheets. Preferably, prior to the provision of the adhesive imprint, the film band is provided in one or more steps with a further printing, preferably through rotary printing with ink, and the removed covering layer is preferably reused.

By covering the film band, after the provision of the imprints, with a covering layer and subsequently rolling it up, the uncut film band is easier to store and transport, and the cutting operation can take place at another location and at a later moment. In this respect, the covering of the imprints has the advantage that the rolled-up film band does not adhere to itself, so that unrolling the film band remains simple, without the imprints being damaged and the film band being undesirably contaminated. Moreover, the covering layer prevents the apparatus to be used for the manufacture of the film sheets from being contaminated by the adhesive. The removal of the covering layer prior to the cutting ensures that the film sheets can be properly connected to each other after cutting, while the covering layer remains undamaged.

By providing the film band with further imprints, each film sheet can in a simple manner be provided with lettering and similar printings for recognition of the origin of the film sheets and the products wrapped therein. As this takes place prior to the provision of the adhesive imprints, the means for providing the further printing are prevented from being contaminated with the adhesive. The provision of the imprints and further printings by means of rotary printing has the advantage that it can be performed continuously as the band of film is passed through the apparatus, and that the patterns to be provided can be formed relatively arbitrarily. Obviously, reusing the covering layer has environmental advantages.

Further, the invention relates to an apparatus for the manufacture of film sheets provided with adhesive means, to be used for wrapping products, such as flowers and plants, which apparatus according to the invention is characterized in that means are provided for delivering a band of film material and passing said film band along a first printing means, the first printing means being arranged to deliver amounts of adhesive onto the film band to form a series of adhesive imprints, and means being arranged behind the first printing means, viewed in the delivering direction of the film band, for cutting off a sheet-shaped film part each time, provided with at least one adhesive imprint.

For the manufacture of film sheets provided with adhesive means, to be used for wrapping products such as, for instance, flowers and plants, apparatuses are known wherein means are provided for cutting film sheets into a desired, rectangular shape, while behind these cutting means means are arranged for providing an adhesive strip along one of the longitudinal edges of the film sheet extending transversely to the supply direction of the film band. Subsequently, the products can be wrapped in the film sheet. As the means for providing the adhesive strip have been arranged behind the cutting means, in operation, each film sheet, already cut loose, is provided with an adhesive strip and is further processed. Consequently, a film sheet can be positioned at random under the means for providing the adhesive strip, so that errors in positioning the adhesive strip cannot be avoided.

Because in the apparatus according to the invention, the printing means are arranged before the cutting means, the series of imprints will always be correctly positioned on the final film sheets, so that the film sheets manufactured with this apparatus have a constant quality and hence the products wrapped therein obtain, in a convenient manner, a uniform and pleasant appearance.

In a further elaboration of the apparatus according to the invention, means are provided for forming a stack of the cut-off film parts in such a manner that each film part is connected by the adhesive imprint to at least one adjacent film part, with the provision of means for providing a release agent on the film material, means for cutting a film sheet from the stack of film parts, and second printing means, located at the front end of the first printing means, viewed in the supply direction of the film band, for printing the film band with further printing, preferably decorative or informative.

With this apparatus, a stack of suitably shaped film sheets, interconnected by the imprints, can be formed, directly ready for use and provided with a pleasant and decorative appearance, with the inclusion of a release agent between each adhesive imprint and the adjacent film sheet. As the film sheets are interconnected, the stack is easy to manipulate, the release agent offering the advantage that the film sheets are easy to separate, while a proper adhesion remains possible between the adhesive imprint and a part of the film sheet not having the release agent.

In an alternative embodiment of the apparatus according to the invention, at the rear end of the first printing means viewed in the supply direction of the film band, there are provided means for providing on the film band a strip of material, preferably paper, covering at least the adhesive imprints, behind which means are arranged for rolling up the film band together with the covering strip of material, and means for picking up the roll of rolled-up, covered film band and delivering the film band therefrom along a cutting device, a pick-up device being provided between the roll pick-up means and the cutting means for removing the covering layer from the film band. The means for picking up the roll, the means for delivering the film band, the cutting means and the pick-up device are preferably arranged in a separate unit, which can be positioned and used at a distance from the other part of the apparatus.

This preferred embodiment of the apparatus has the advantage that a film band, provided with printing and imprints, can be picked up, stored and transported in one piece, so that the roll can be further processed at another time and even at another location, for instance at the location where the film sheets are to be used. Storing and transporting the roll instead of cut film sheets has great advantages. For instance, the chance of damage and contamination is smaller and a roll is easy to pack and handle.

The invention further relates to film sheets to be used for wrapping products such as, for instance, flowers and plants, which, according to the invention, are provided with imprints in adhesive material, to a stack of such film sheets and to a rolled-up film band, provided with imprints in adhesive material and suitable for use for the manufacture of such film sheets.

In explanation of the invention, exemplary embodiments of a method and apparatus, and of film sheets according to the invention, will be described hereinafter, with reference to the accompanying drawings.

DETAILED DESCRIPTION

Figure 1:
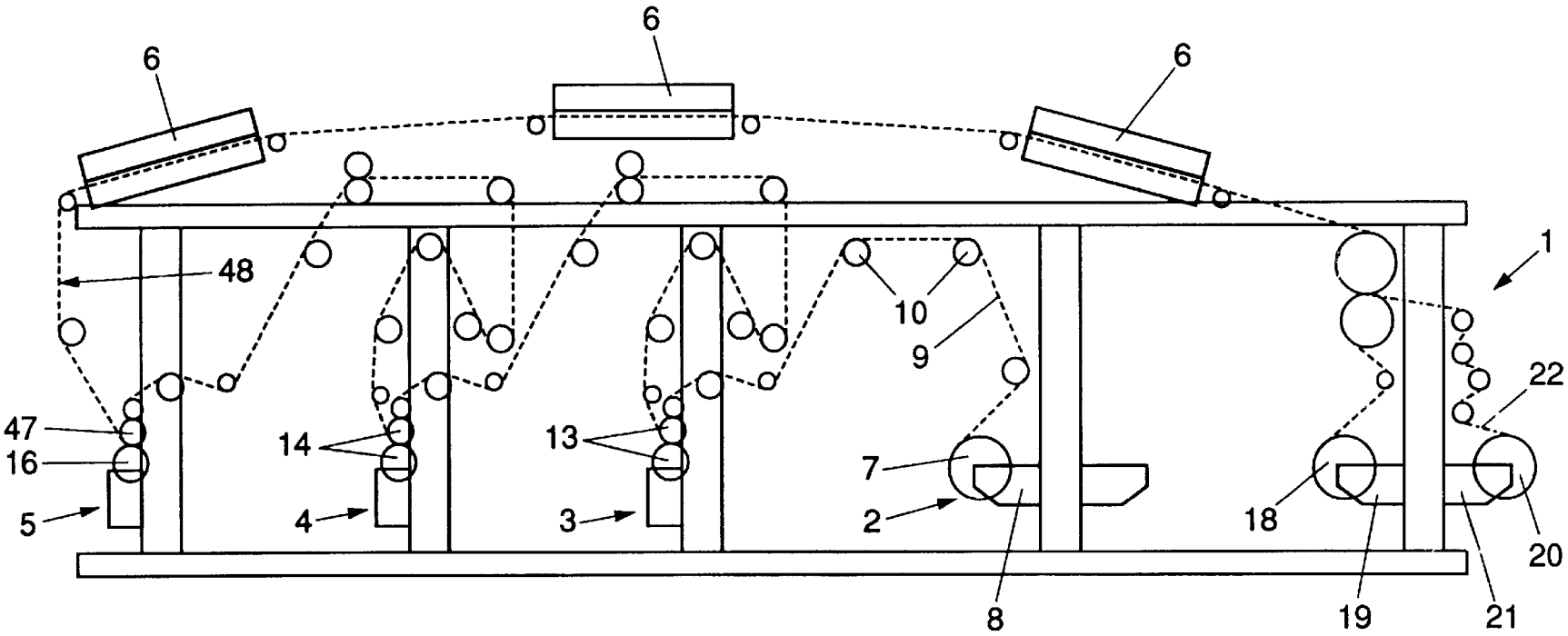
FIG. 1 is a schematical side elevation of a first part of an apparatus according to the invention.

FIG. 1 shows at the bottom side, from right to left, a winding device 1, an unwinding device 2, a first ink printing device 3, a second ink printing device 4 and a glue imprinting device 5. At the top side, three heating elements 6 are shown. The unwinding device 2 comprises a roll of film band 7, rotatably suspended in a roll container 8. A band of film 9, shown in the drawing as a dashed line, extends from the roll 7 along a plurality of drive and guide rolls 10, the first ink printing device 3, the second ink printing device 4, the glue imprinting device 5 and the heating elements 6, in the direction of the winding device 1.

Figure 3:
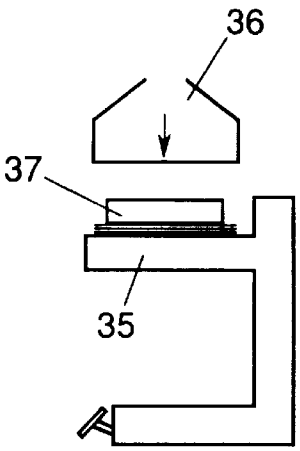
FIG. 3 is a front view of a blanking device for use in a method according to the invention.
Figure 4:
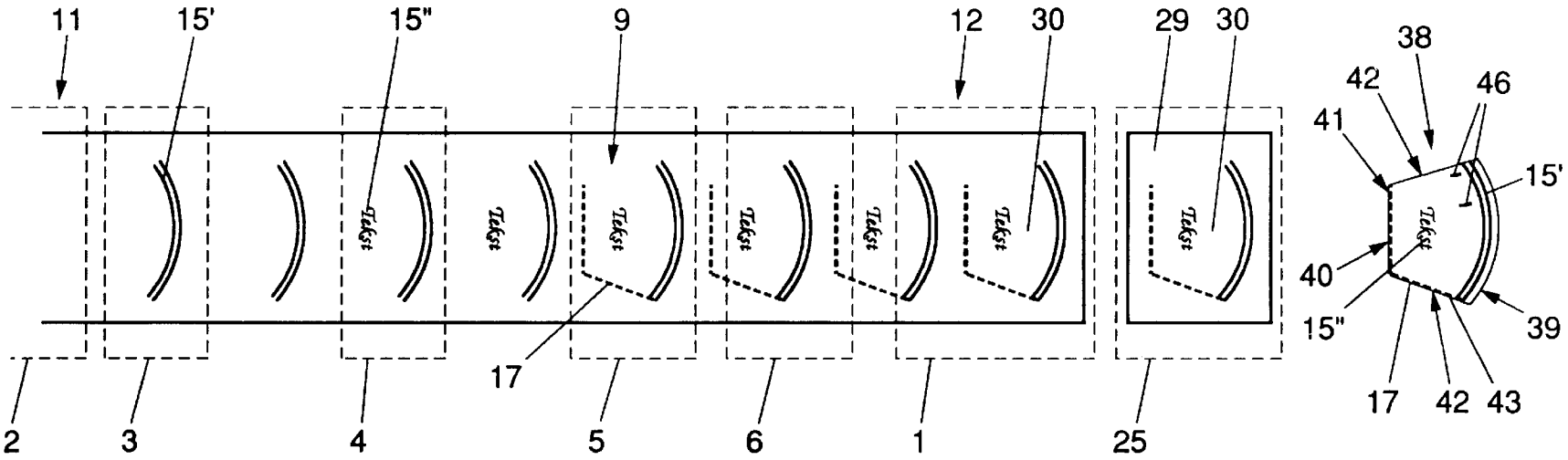
FIG. 4 is a top plan view of a film band in a number of successive processing steps according to the invention.

FIG. 4, on the left, shows in top plan view a film band 9, with the left-hand end 11 connecting to the film roll 7 and the right-hand end 12 connecting to the winding device 1. On the film band 9, the processing stages of the film band 9 are indicated by means of six frames, the reference numeral of a frame corresponding to a reference numeral in FIGS. 1, 2 and 3.

The film band 9 is unwound from the roll 7 and successively passed along the first ink printing device 3 and the second ink printing device 4. In the ink printing devices, the film band 9 is provided, by means of rotary printing rolls 13 and 14 respectively, with a decorative and informative printing 15' and 15", in one or more colors. Of course, it is also possible to provide any other amount of such ink printing devices. Subsequently, the film band 9 is passed along the glue imprinting device 5, wherein, by means of glue imprinting rolls 16, an adhesive imprint 17 is provided, next to or across the printings 15', 15". Moreover, by means of a release agent printing roll 47, a release agent 48 is provided on the side of the film band 9 remote from the imprints 17. The release agent has as a property that it reduces the adhesion of the adhesive imprint relative to a part of the film band that is provided with the release agent. However, it does not do so relative to a part of the film band that is not provided with the release agent. It is further noted that for providing the adhesive imprint, means other than a glue imprinting device may be used as well. The adhesive imprint may have any desired shape and may be provided in different adhesive materials.

Contiguously, the film band is passed along three heating elements 6, whereby the printings and the imprints are dried. In this manner, a film band 9 is obtained in a continuous printing process, which film band comprises a series of identical, equally spaced printing patterns 30, each built up of printings 15', 15" and adhesive imprints 17.

After drying, the film band 9 is fed to the winding device 1. This winding device 1 comprises a winding roll 18, rotatably suspended in a second roll container 19, and a covering film delivery roll 20, rotatably suspended in a third roll container 21. During the supply of the film band 9, a covering film 22 is delivered from the covering film delivery roll, shown in the drawing as a dash and dot line. The covering film 22 is disposed on the film band 9 in such a manner that at least the imprints 17, but preferably the entire film band 9 is covered therewith. Subsequently, the film band 9, together with the covering film 22, is wound on the winding roll 18, the bands of film 9, wound over each other, thus being separated by the covering film 22, so that the adhesive imprints 17 do not adhere to the adjacent film 9. Hence, the covering film 22 has the advantage that the imprints 17 are protected thereby and that the film band 9 is prevented from being contaminated due to the delivery of the adhesive material of the imprints 17 at undesired locations on the film 9. Moreover, the covering film 22 prevents the apparatus from being contaminated by the adhesive imprints 17.

After the winding of the film band 9, the winding roll 18, together with the printed film band 9, can be removed and, for instance, packed, stored, transported and further processed. As the film band 9 is wound on the winding roll 18, it is easy to handle. The winding roll retains its shape and is relatively compact, and has moreover the advantage that it can simply and uniformly be included in further processing devices.

Figure 2:
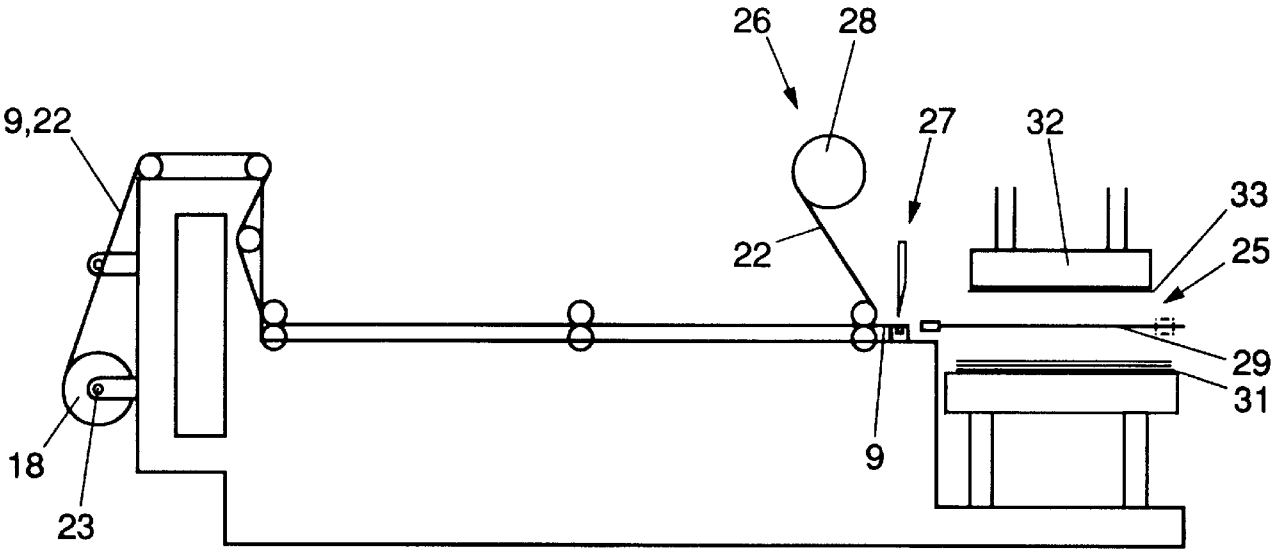
FIG. 2 is a schematical side elevation of a second part of an apparatus according to the invention.

Further processing of the printed film band preferably takes place in a second part of the apparatus according to the invention, which may or may not be designed as a separate unit, as is shown in FIGS. 2 and 3.

FIG. 2, on the left, shows a fourth roll container 23, wherein the winding roll 18 is rotatably suspended. The printed film band 9, covered by the covering film 22, extends from the winding roll 18 over a plurality of drive and guide rolls 24 in the direction of a stacking device 25, shown in FIG. 2 on the right. Arranged between the winding roll 18 and the stacking device 25 are, successively, a removing and winding device 26 and a cutting device 27. In the removing and winding device 26, the covering film 22 is removed from the film band 9 and rolled up on a winding roll 28. The winding roll 28 can be taken away and inserted into the first part of the apparatus, shown in FIG. 1, allowing the covering film 22 to be reused.

After the covering film 22 has been removed from the film band, the film band 9 is passed through the cutting device 27. The cutting device 27 comprises a cutter 28, extending transversely to the supply direction of the film band 9 and capable of cutting a film part 29 from the film band 9 each time. The cut film parts 29 are each provided with one printing pattern 30, provided on the top side, and a release agent 48, provided on the bottom side. The film parts 29 are stacked on top of each other in such a manner that the printing patterns 30 are arranged directly above each other. Subsequently, the stack 31, built up of film parts 29, is pressed down by means of a pressure means 32, so that the different film parts 29 are mutually interconnected via the adhesive imprints 17 and the release agent 48. On the side facing the film parts 29, the pressing agent 32 is provided with a covering film part 33 which does not adhere to the imprint 17, preventing the stack 31 from being moved upward together with the pressure means 32. Moreover, it prevents contamination of the apparatus. FIG. 3 shows a blanking device 34, comprising a table 35 and a pressure means 36. Positioned on the table 35 is a stack 31, built up of film parts 29, with a blanking die 37 thereabove. The blanking die 37 has a contour corresponding to the desired shape of the final film sheets 38 to be made, as shown in FIG. 4, on the far right, and is positioned relative to the stack 31 such that the printing patterns extend in the desired position at least substantially within the contour. By subsequently moving the pressure means 36 downward, the blanking die 37 is pressed through the stack 31 and a stack of film sheets 38 is cut with the desired shape, which film sheets are interconnected by the adhesive imprints 17. When the film sheets 38 are blanked, it may be advantageous if the adhesive imprints 17 partly extend outside the contour. As a result, after blanking, the residual material will stick together, allowing it to be removed from under the pressure means 32 in a simple manner in one operation.

The blanking device 34 can be constructed independently of the further apparatus, but the pressure means 32 of the second part of the apparatus, shown in FIG. 2, can also be used as pressure means 36 of the blanking device 34. This last construction has as an advantage that the blanking operation can be carried out contiguously to the cutting operation, without the stack 31 having to be displaced for that purpose, but this does not allow any further stacks 31 to be formed at the same time, so that only alternately a stack 31 can be formed and a stack 31 can be cut.

Figure 5:
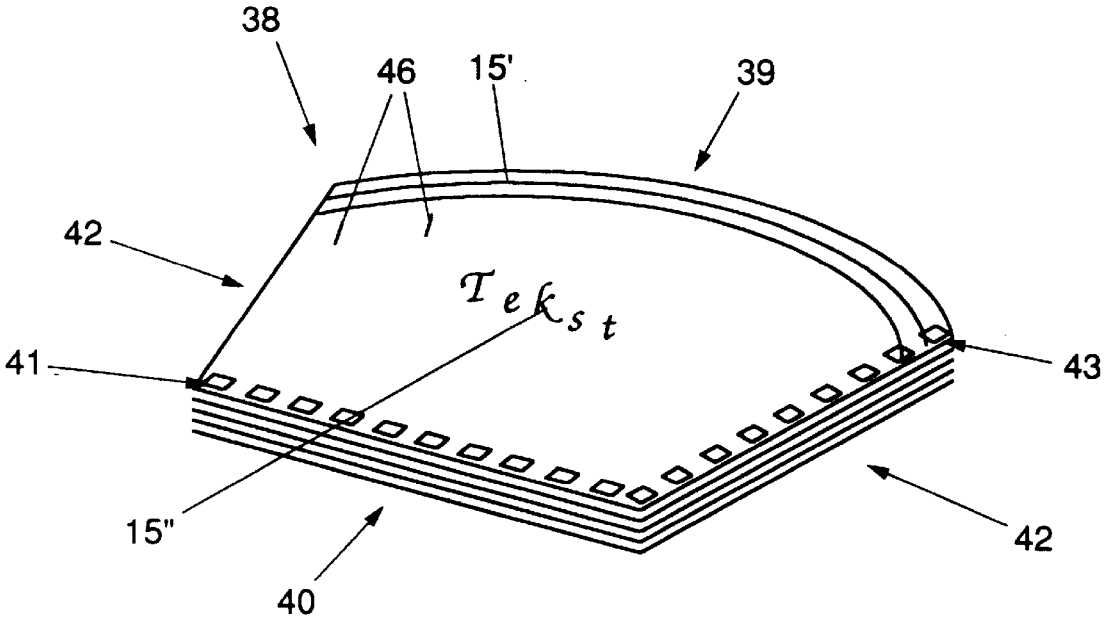
FIG. 5 is a perspective view, in enlarged form relative to FIG. 4, of a stack of film sheets according to the invention.

A film sheet 38 formed with a method according to the invention has for instance the shape shown in FIG. 4, but may of course have any desired shape, including the rectangular shape of the film sheet 29, in which case further processing can be omitted. The model of film sheet 38 shown in FIG. 4 has a curved top edge 39, along which the decorative printing 15' extends, a straight bottom edge 40, comprising a first strip 41, and two side edges 42, extending obliquely relative to the bottom edge, with a second strip 43 extending along one of the side edges 42. The two strips 41 and 42 include an angle and together form the adhesive imprint 17. Each strip 41, 42 is built up of a series of adhesive surfaces 44, separated by interspaces 45 on which no adhesive means has been provided. This creates an adhesive strip extending over the entire length of the side of bottom edge 42, 40 in the form of an adhesive dotted line. This has the advantage that the film sheets can be interconnected along two longitudinal edges, so that a firm stack of film sheets is formed that is easy to handle, as shown in FIG. 5. The stack can essentially be handled as a firm block of film sheets 38. Further, this stack of film sheets 38 has the advantage that the strips 42, 43, designed as adhesive dotted lines, enable the film sheets to be pulled loose in a simple manner. This pulling loose is further simplified as between each adhesive imprint 17 and the film sheet 38, adjacent in the stack 31, the release agent 48 is provided. As has been observed above, the imprint 17 may have any shape, so that other parts of the film sheet 38 may also be provided with at least a part of the adhesive imprint 17.

After the film sheet 38 has been pulled loose from the stack, a bunch of flowers, for instance, may be wrapped therein, the adhesive strip 43 on the outside being pressed against the film sheet 38, so that it is adhered thereto. Here, the adhesive imprint 17 is pressed at least substantially against a part of the film sheet 38 that is not provided with release agent 48, so that the proper adhesion is ensured. After all, the adhesive action of the imprint relative to the film material is in itself not influenced adversely by contacting the release agent 48 in the stack 31. The adhesion of the adhesive imprint 17 to the release agent 48 is only less than the adhesion of the adhesive imprint 17 to the film material. Thus it is ensured that the wrapped bunches of flowers obtain a pleasant and uniform appearance. As a matter of fact, a bunch of flowers may also be wrapped in another manner in a film sheet according to the invention. In this connection, it is particularly advantageous if each film sheet is provided with means for marking a preferred position of a bunch of flowers relative thereto. In the embodiment of the film sheet shown in FIG. 5, these markings are provided in the printing 15' or 15" in the form of two marking lines 46 provided in spaced relationship, but, obviously, many embodiments are possible.

In the film sheets according to the invention, other products can be wrapped as well. For instance, plants in pots can be wrapped, in which case the adhesive strip 41, extending along the bottom edge 40, can be adhered to the pot, and the adhesive strip 43, extending along the side edge 42, can be adhered to the outside of the film sheet 38. Further, the film sheets 38 can be used as a gift wrapping or as a wrapping for, for instance, confectionery and the like. The film sheets 38 may be provided with another number of adhesive strips, such as, for instance, one straight or curved adhesive strip or adhesive strips along two opposite longitudinal edges which may or may not be parallel. Moreover, the side edges may be composed of longitudinal edge parts including an angle relative to each other, while the different longitudinal edge parts are each provided with an adhesive strip. As a matter of fact, adhesive imprints may also be provided on two sides of the film band 9. This may for instance provide a fastening possibility on the outside of each film sheet 9, on which a label can be fastened simply by arranging the label against the adhesive imprint.

As has been described hereinabove, with the method according to the invention, stacks of film sheets can be formed, but is it also possible to form single film sheets 38 which can directly be used for wrapping, for instance, flowers or plants. Here, the film band is in the same manner provided with a series of printing patterns. Accordingly, the film sheet 9 is directly fed to the cutting device, which cuts the required film part 29 each time. Particularly in the case where rectangular film sheets 38 are used for wrapping bunches of flowers or other products, this has the advantage that the film sheets 38 can be used directly, while the covering film 22 and the release agent 48 need not be provided, the pressure means 32 can be omitted and the film sheet need not be blanked. In this embodiment of the method, the film band 9 should be cut and further processed contiguously to the printing process, while the film band cannot be stored and transported between times. Moreover, the cutting of the film band 9 and the wrapping will usually take up so much time that the printing process cannot be performed at the desired speed, with all disadvantages involved. By using the apparatus as shown in the drawing, this problem can easily be avoided by the possibility of putting a number of second parts of the apparatus (FIGS. 2, 3) into action parallel behind the first part of the apparatus (FIG. 1).

In the method according to the invention, it is preferred that the printings 15', 15" and the imprints 17 are provided on the film band by means of a rotary printing process. This has the advantage that the printings 15', 15" and the imprints 17 can be provided in a continuous process while the film band 9 is being fed through, allowing the mutual positions of the printings 15', 15" and the imprints 17 to be checked properly, so that uniform film sheets are produced. However, it is also possible to provide the printings 15', 15" and imprints on the film band 9 by means of other printing processes, for instance by means of screen-printing. As indicated, the release agent 48 can be provided by means of an printing roll 47, but it may also be provided in another manner, for instance through spraying on. Moreover, the release agent may be provided on the film material both before and after the cutting of the film band.

The invention is by no means limited to the exemplary embodiments given in the specification. Within the scope of the invention, many variants are possible. For instance, more or fewer printing devices may be arranged, the first part of the apparatus may be coupled directly to a cutting device and the film sheets 38 may be cut from the stack of film parts 29 by means other than a blanking die. Further, obviously, several printings and imprints may be provided sided by side on the film band and the film parts may comprise several printing patterns. Further, it is possible to provide the film band, before it is placed on the unwinding roll 7, with a decorative and/or informative printing 15', 15" in a separate printing process. Moreover, it is possible to blank the film sheets 38 directly from the film band 9, without rectangular film parts 29 being cut therefrom first by means of a cutting device, and the release agent may be omitted.

I claim:

1. A wrapper comprising a film sheet having a first side and a second side, the first side including a plurality of adhesive surfaces provided in a spaced relationship with one another and extending along at least two longitudinal edges of the sheet, the first side also including at least one visible non-adhesive printed mark that indicates a preferred position of a product including a portion of a plant relative to the film sheet, the second side having a release agent applied to a portion of the second side to partially provide the second side with a release agent such that when a plurality of film sheets are stacked, the release agent is positioned between the adhesive surfaces on the first side of the film sheet and adhesive surfaces on a first side of an adjacent film sheet.

2. A stack of wrappers built from a plurality of interconnected, individual film sheets wherein each individual film sheet has a first side including a visible non-adhesive printed ink mark that indicates a preferred position of a product including a portion of a plant relative to the film sheet, the first side further including an adhesive imprint comprising a plurality of adhesive surfaces provided in a spaced relationship with one another an extending along at least two intersecting edges of the individual film sheet, and a second side wherein a release agent is applied to a portion of the second side to partially provide the second side with a release agent imprint such that when the plurality of film sheets are stacked, the release agent is positioned between the adhesive imprints on the first side of the film sheet and a first side of an adjacent film sheet.

3. A roll of wrappers, provided with imprints in material and having at least one film sheet, said film sheet comprising a first side including an adhesive imprint having a plurality of adhesive surfaces provided in a spaced relationship with one another and extending along two longitudinal edges of the film sheet, the first side further including a visible non-adhesive printed mark that indicates a preferred position of a product including a portion of a plant relative to said film sheet, said film sheet further comprising a second side having a release agent applied to a portion of the second side to partially provide the second side with a release agent imprint such that when a plurality of said film sheets are rolled, the release agent is positioned between the adhesive imprints on the first side of the film sheet and a first side of an adjacent film sheet.

4. The sheet of claim 1, wherein at least one corner of the first side of the film sheet is free of adhesive surfaces.

5. The sheet of claim 3, wherein at least one corner of the first side of the film sheet is free of adhesive surfaces.

6. A wrapper comprising a film sheet having a first side including a plurality of adhesive surfaces provided in spaced relationship with one another and extending along two intersecting edges of the sheet, the first side further including a visible non-adhesive printed mark indicating a preferred position of a product including a portion of a plant relative to the film sheet, at least one corner of the first side being free of the adhesive surfaces, the film sheet also including a second side having a release agent applied to a portion of the second side to partially provide the second side with a release agent surface such that when a plurality of film sheets are stored in a manner that results in contact between the second side of the film sheet and an adhesive surface on the first side of an adjacent film sheet, the release agent surface on the second side of the film sheet is positioned between the first side of the film sheet and an adhesive surface on the first side of the adjacent film sheet.

* * * * *